United States Patent [19]

Gold et al.

[11] Patent Number: 4,561,223

[45] Date of Patent: Dec. 31, 1985

[54] PANEL FASTENER SYSTEM AND RETAINING MEMBER

[75] Inventors: Stanley Gold, Mahopac; Robert Newman; Eric Lavigne, both of Hopewell Jct., all of N.Y.

[73] Assignee: Defender Energy of Connecticut, Inc., Bridgeport, Conn.

[21] Appl. No.: 463,629

[22] Filed: Feb. 3, 1983

[51] Int. Cl.[4] ..... E06B 3/26

[52] U.S. Cl. ..... 52/202; 52/DIG. 4; 52/400; 52/476; 52/208; 49/478

[58] Field of Search ..... 52/202, 203, 400, DIG. 4, 52/208, 788, 476; 49/478, 501, 403; 24/303

[56] References Cited

U.S. PATENT DOCUMENTS

| | | | |
|---|---|---|---|
| 1,694,676 | 12/1928 | Will . | |
| 2,219,699 | 10/1940 | Owen | 20/56.5 |
| 2,595,833 | 5/1952 | Flaherty | 160/369 |
| 2,631,340 | 3/1953 | Decker | 20/55 |
| 2,780,846 | 2/1957 | Lyon | 20/56.4 |
| 2,855,242 | 10/1958 | Holmes | 296/97 |
| 2,943,246 | 6/1960 | Riordan | 317/159 |
| 3,016,952 | 1/1962 | Shero | 160/354 |
| 3,133,324 | 5/1964 | Foreman | 20/52 |
| 3,175,603 | 3/1965 | Tonnon | 160/107 |
| 3,214,879 | 11/1965 | Ellingson, Jr. et al. | 52/720 |
| 3,299,591 | 1/1967 | Woelk | 52/203 |
| 3,376,615 | 4/1968 | Heckman | 52/DIG. 4 |
| 3,797,151 | 3/1974 | Dexter | 40/129 |
| 3,824,753 | 7/1974 | Anderson | 52/203 |
| 3,911,630 | 10/1975 | Nally | 52/2 |
| 3,955,331 | 5/1976 | Williams | 52/397 |
| 3,971,178 | 7/1976 | Mazzoni et al. | 52/172 |
| 3,992,815 | 11/1976 | Potter | 49/62 |
| 4,021,980 | 5/1977 | Wilfong | 52/202 |
| 4,068,428 | 1/1978 | Peterson, III | 52/202 |
| 4,069,641 | 1/1978 | DeZutter | 52/202 |
| 4,079,558 | 3/1978 | Gorham | 52/202 |
| 4,112,642 | 9/1978 | D'Aragon | 52/202 |
| 4,134,240 | 1/1979 | Bologna et al. | 52/202 |
| 4,160,348 | 7/1979 | Chapman et al. | 52/202 |
| 4,182,088 | 1/1980 | Ball | 52/202 |
| 4,194,331 | 3/1980 | Gingle | 52/203 |
| 4,272,934 | 6/1981 | Cowden | 52/202 |
| 4,351,137 | 9/1982 | Enyart et al. | 52/202 |
| 4,387,541 | 6/1983 | Boomershine | 52/202 |
| 4,407,099 | 10/1983 | McLaughlin | 52/202 |
| 4,409,758 | 10/1983 | Dickerson | 52/202 |
| 4,441,290 | 4/1984 | Abell | 52/202 |
| 4,452,020 | 6/1984 | Werner | 52/202 |
| 4,473,980 | 10/1984 | Foster | 52/202 |

FOREIGN PATENT DOCUMENTS

| | | |
|---|---|---|
| 273691 | 11/1964 | Australia . |
| 707857 | 4/1965 | Canada . |

OTHER PUBLICATIONS

Drawing of Prior Art Storm Window Known to Applicants.

*Primary Examiner*—John E. Murtagh
*Assistant Examiner*—Kathryn Ford
*Attorney, Agent, or Firm*—Cifelli Frederick & Tully

[57] ABSTRACT

A panel fastener system is provided for securing a panel sheet to a frame across an opening, e.g. window opening. The system comprises a frame member mounted along the length of the frame and having a first magnetic element non-adhesively mounted to the frame member. A panel sheet is provided of suitable size to cover the opening. A panel retaining member extends along is mounted to the edges of the panel. The retaining member has an outer and an inner leg connected to each other at one end, the edges of the panel being retained and mounted therebetween. A second magnetic element is non-adhesively mounted to the inner leg. The first and second elements are magnetically attachable to each other. The inner leg and second magnetic element mounted thereto are both shaped and mounted to each other to form a rigidized elongated hollow structural member therebetween along the length of the edges of the panel. The frame member preferably comprises two legs hingedly mounted to each other at substantially right angles, one leg of which is mounted to the length of the frame and the other leg having mounted thereto the first magnetic element.

The rigidized elongated hollow structural member provides rigidity to the sheet and added support. The hinged frame member legs provide flexibility while still providing for secure fastening of the panel to the frame. The non-adhesive mountings of the magnetic elements to the frame and panel members insures a secure mounting.

18 Claims, 15 Drawing Figures

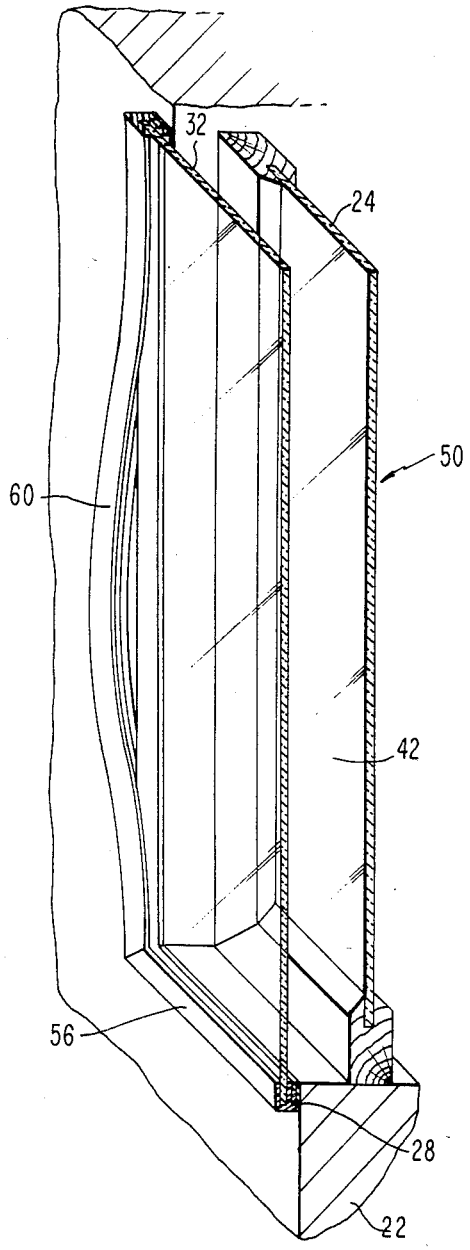
FIG. 1
PRIOR ART
FIG. 1A
PRIOR ART
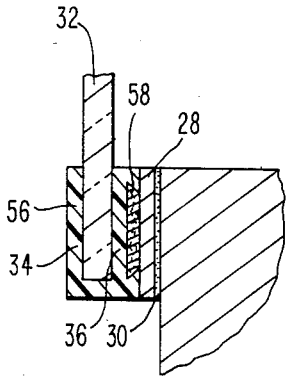

PANEL FASTENER SYSTEM AND RETAINING MEMBER

BACKGROUND OF THE INVENTION

1. Field of the Invention

This invention relates to a panel fastener system for securing a panel to a frame across an opening, and particularly relates to storm windows using a magnetic type fastening system which is easily installable and removable and maintains its integrity when subjected to the environmental conditions of use.

2. Prior Art

With the increase in the cost of energy for both heating and cooling and the recognition of the desirability to conserve energy, the art of insulating homes, in particular the insulating of existing windows and doors, is receiving continuing and increased attention. A substantial percent of the homes heat loss in the winter and heat gain in the summer is through glass panes of windows and doors. Traditional means of insulating against this loss or gain have included the use of heavy and expensive storm windows, the glass of which requires separate frames of wood or aluminum. However, windows of this type do not provide efficient insulating capability due to air infiltration into the conditioned zone. In addition windows of this type typically interfere with and detract from the beauty of the windows from both the inside and outside.

Another popular means of insulating the window area is the provision of insulating glass which is manufactured in multiple thicknesses of either two or three sheets, each separated by an air space from the other prior to assembly into the sash. While the insulating capabilities of glazing of this type are far superior to those of a single glass pane, the increased cost of multiple thickness glazing has discouraged its use in many instances. In addition, double glazing is impractical for windows which have an existing single pane, since the sash is not designed to accommodate the increased weight and thickness of the double glazed panels. Thus, although it has long been recognized that double glazed windows possess much greater insulating ability than single glazed windows, most installations have been provided with a single glazing for the sake of economizing on construction costs. Thus, it has become increasingly desirable to convert single glazing to double glazing, not only for improving the insulating properties, but also for the sake of advantages which may be obtained from the addition of a tinted or reflectively coated pane. Unfortunately, removing and discarding existing windows and installing double glazed units in its place is usually prohibitive in cost.

Thus, there have been developed numerous types of fastener systems for mounting either flexible or rigid glazing panels to existing window openings. Such fastener systems have met with varying degrees of success. Generally these systems may be divided into two categories: (1) glazing fastener systems which mechanically attach the glazing sheet to the frame of the window by mechanical clip means, e.g. velcro, frictional clips; and (2) glazing fastener systems which magnetically attach the glazing sheet to the frame. Numerous type systems exist for the first type, some of which are enumerated herein. However, the magnetic systems, were developed to overcome some of the problems associated with the mechanical type systems, in particular providing for the ease of installation and removal of the glazing sheet.

One type of magnetic glazing fastener system is depicted in FIG. 1, for example MAGNETITE magnetic storm window from Viking Energy Systems, Co., Hanover, Mass. It has been found that this type system has certain disadvantages which can be attributed to a combination of the environmental conditions the system is exposed to and the limitations of the system, per se, which result in improper sealing and insulation problems.

Referring to FIG. 1, this prior art system has a steel element (28) adhesively mounted at (30) along the length of the frame (22). The window opening (50) is provided with the conventional primary glazing sheet (24). This prior art system is further provided with a glazing retaining member (56) extending along and mounted to the edge of the glazing sheet (32). The retaining member (56) depicted has outer and inner legs (34, 36 respectively) which are connected to each other at one end. The edges of the sheet are retained and mounted therebetween. A rubber bound barium ferrite magnetic element (58), in extruded strip form, is mechanically mounted to the inner leg (36). The glazing sheet (32) having the glazing retaining member (56) surrounding it is then mounted to the steel element (26).

The disadvantages of this system can be appreciated in that the air insulation chamber (42) created by the glazing sheet (32) and the primary glazing sheet (24) can reach a temperature of up to 160° F. due to the sunlight filtering through the primary glazing sheet (24). Such a high temperature creates a number of problems. The failure temperature of economically acceptable adhesives used to attach the steel element (28) to the frame (22) is typically about 175° F. This means that even at 150° F. the adhesive tends to soften and grow weak. Additionally the steel element (28) tends to expand less and at a different rate than the polymeric adhesive and carrier, e.g. PVC based tape. This stresses the adhesive bond. Additionally, the polymeric glazing sheet (32), and the glazing retaining member (56) tend to become soft and pliable upon heating. This causes the sheet (32) to sag due to its own weight resulting in the breaking of the magnetic and/or adhesive bond causing the window to sag and fall (see 60—FIG. 1). This is a safety hazard and can cause damage to the glazing fastener system. Many manufacturers of similar type magnetic frames are aware of this problem and provide clips which are placed around the perimeter of the frame. Such clips cost the consumer money and labor and detract from the overall appearance of the window. Additionally, such clips detract from the value of the system in being easily removable and installable.

Still further in order for the magnetic elements to attract each other properly to obtain maximum attachment force, e.g. 4 to 8 pounds of pull per linear foot, the magnetic elements must make flush contact with each other. Most windows are not perfectly square. Ridges, bumps, tapers, slants, etc., exist in the frame for a variety of reasons, e.g. the building settles, the frame shifts with climatic changes and age, wood warps, design reasons require a slight taper or bevel, wear causes sections of the casing to dislodge or shift slightly, etc. It is thus desirable to provide for these irregularities.

More specifically, there are numerous known types of storm windows and moldings, see for example the following U.S. Pat. Nos.:

2,219,699 to Owen;

2,631,340 to Decker;
2,780,846 to Lyon;
3,133,324 to Foreman;
3,175,603 to Tonnon;
3,214,879 to Ellingson, Jr. et al;
3,299,591 to Woelk;
3,824,753 to Anderson;
3,911,630 to Nally;
3,955,331 to Williams;
3,971,178 to Mazzoni et al;
3,992,815 to Potter;
4,021,980 to Wilfong;
4,068,428 to Peterson III;
4,069,641 to DeZutter;
4,079,558 to Gorham;
4,112,642 to D'Aragoni;
4,134,240 to Bolonga et al;
4,160,348 to Chapman et al; and
4,194,331 to Gingle et al.

Of the aforementioned U.S. patents only the following describe the use of magnetic elements to mount the storm window to the sash or an element attached thereto:

Owen describes a double glazed window construction comprised of a sash, a pane of glass in the sash and a plurality of magnets secured at spaced intervals around the periphery of the sash. A second pane of glass is positioned within the sash and spaced from the first pane. Magnets and metallic means co-acting with the magnets releaseably secure the second pane of the glass to the sash. The metallic means described are a metallic retainer strip lying on the outer side of the second pane of glass having an annular frame of metal of substantially U-shaped cross section, which surrounds the pane of glass.

Foreman provides a weather stripping means around the entire perimeter of the sash of a double hung window while simultaneously providing anti-rattle window support and position control at all levels of window elevation. This is accomplished by means of a continuous pliable magnetic strip which is mounted along the entire length of three sides of the sashes. Cooperating with the magnetic strip is a magnetizable steel strip which is in aligned relationship thereto. The magnetic strip may be secured and positioned by the use of adhesives or by a pressed fit in a groove or slot shaped to accommodate the magnetic strip.

Anderson describes a storm sash and structure for installation of the storm sash on a prime window sash. The storm sash includes a generally "U" shaped dual durometer hardness plastic strips secured to a glazed panel around the periphery thereof.

Peterson, III describes an insulating window which includes a transparent, rigid sheet of plastic having spaced hook-and-loop fastening elements (Velcro) adhered thereto in areas about the margin of one face thereof. Complimentary spaced hook-and-fastening elements are attached to the inside window frame of a house. Weather stripping is attached directly to the same face of the sheet of plastic about the margin thereof to form a seal between the sheet of plastic and internal window casing frame.

Gorham describes an outer portion of rigid plastic and of generally U-shaped configuration. A transparent plastic is inserted into the open end of the U and the legs are spread sufficiently to firmly grip the pane material. This can be mounted to flat strips of magnetic material secured to the side and top facings by, for example, weather resistant cement. The inner and outer portions are joined by a central portion which is hollow and sufficiently resilient to compensate for irregularities. This system provides no rigidity for the pane material and the magnetic materials force is dissipated by the material which forms the central cavity and causes slippage between the surface and strip.

Gingle et al describes a system for double glazing existing panes and windows or the like wherein a pane of material is cut to the shape of the exposed surface of an existing window pane in its sash. The additional pane is secured to the existing pane through the use of magnetically intermatible spacer strips which are secured to the existing panes around their outer periphery by means of an adhesive. The intermatible spacer strips are of a thickness which allows for separation of the two panes by a sufficient distance to create an air space therebetween to enhance the insulating properties of the structure. A thin flexible strip of decorative material is secured to the surface of the attachable pane opposite the existing pane along its periphery so as to overlap the adhesive on the opposite face of the attached pane while extending outward to overlap the inside edges of the sash and thereby additionally seal and insulate the area around the outer periphery of the attached pane.

SUMMARY OF THE INVENTION

It is an object of this invention to provide a panel fastener system which is easily removable and installable and which may be used in a residential or commercial environment.

It is a further object of this invention to provide an internal insulating window which can be easily prepared for mounting, can be repetitively mounted and removed, has good insulating qualities, can be mounted securly to a window frame, is difficult to detect, presents a good appearance if detected and is relatively inexpensive to manufacture.

It is still a further object of this invention to provide a method or means for quickly and easily converting a single glazed window into a double glazed window.

It is a further object of this invention to provide a means for converting a single glazed window into a double glazed window which is easy to install, readily adaptable to any size window opening or frame construction, has superior moisture barrier integrity, and improved structural strength.

It is still a further object of this invention to provide a magnetic type glazing system wherein the glazing is prevented from sagging during the heating and cooling of the air insulation chamber.

The foregoing objects are achieved by the panel fastener system of this invention for securing a panel to a frame across an opening. The system comprises a frame member mounted along the length of the frame and having a first magnetic element non-adhesively mounted to the frame member. A panel is provided of suitable size to cover the opening. A panel retaining member extends along and is mounted to the edges of the panel. The retaining member has an outer and an inner leg connected to each other at one end, the edges of the panel being retained and mounted therebetween. A second magnetic element mounted to the inner leg. The first and second elements are magnetically attachable to each other. The inner leg and second magnetic element mounted thereto are both shaped and mounted to each other to form a rigidized elongated hollow structural member therebetween along the length of the edges of the panel. The frame member preferably comprises two legs hingedly joined to each other at substantially right angles, one leg of which is mounted to the length of the frame and the other leg having mounted thereto the first magnetic element.

The rigidized elongated hollow structural member along the length of the edges of the panel provides rigidity to the panel and added support preventing sagging. The hingedly joined frame member legs provide sufficient flexibility to allow for the ridges, bumps, tapers, and slants along the length of the frame member while still providing for secure fastening of the panel to the frame. The non-adhesive mountings of the magnetic elements to the frame member and panel member insures a secure mounting, even during normal or adverse conditions, e.g. heat, humidity, etc.

BRIEF DESCRIPTION OF THE DRAWINGS

A complete understanding of the invention will be obtained from the following detailed description taken together with the drawings in which:

FIG. 1 is a perspective interior view, partially broken away, of a Prior Art double glazing window structure.

FIG. 1A is an enlarged, detailed view of the Prior Art structure of FIG. 1.

DETAILED DESCRIPTION OF THE INVENTION

Figure 2:
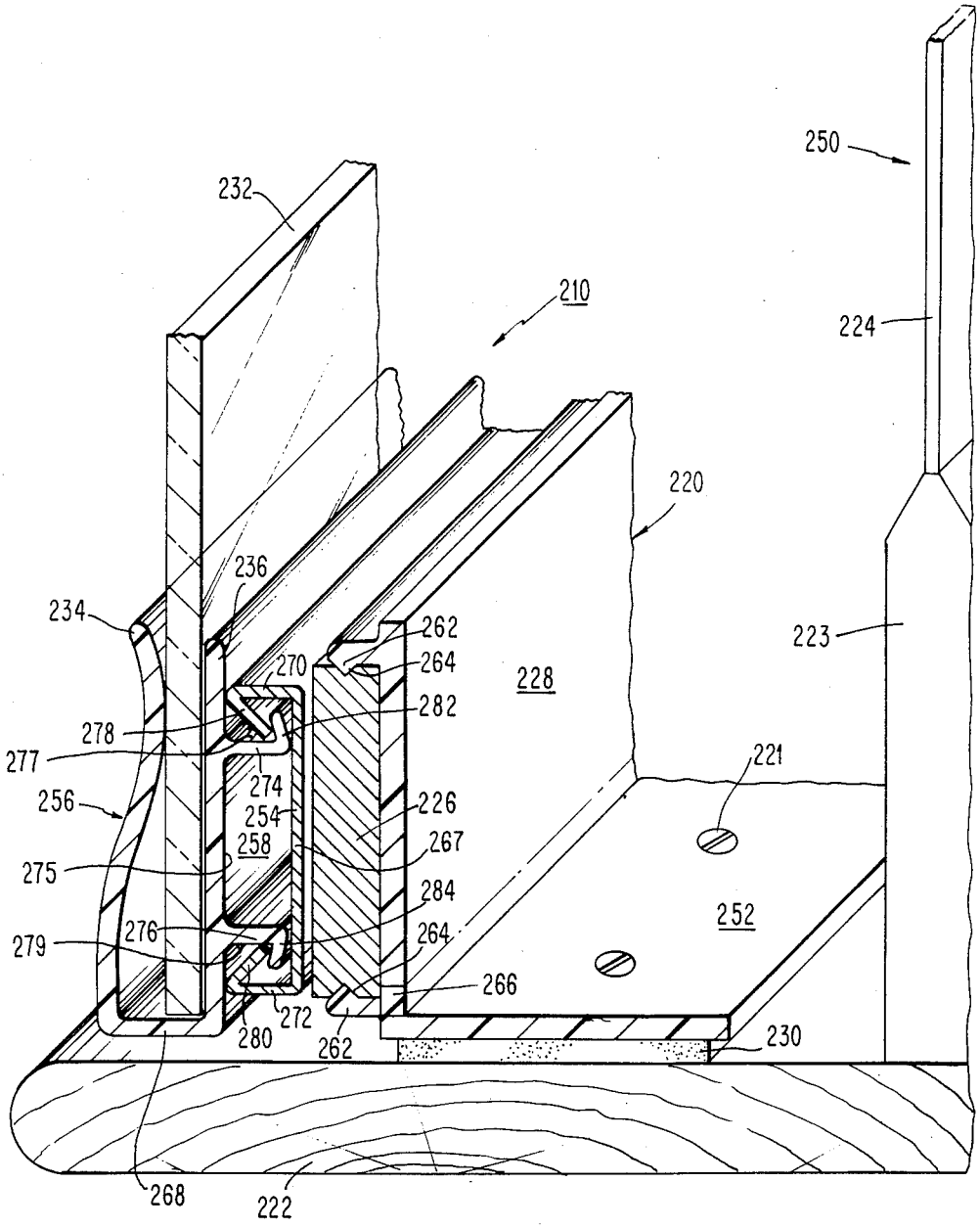
FIG. 2 is a perspective interior view, partially broken away, of a typical single glazed window upon which an embodiment of the present invention has been installed.

FIG. 2, shows a conventional window frame (222) typically made of wood or metal and surrounding a fixed translucent primary glazing sheet (224), e.g. a window pane. The pane (224) is secured to the sash (223) in a recess and is held in position with a suitable silicon or cork bead which seals the periphery of the pane against the weather. The sash (223), as shown, is substantially rectangular in form and usually has mounted thereon a handle or other suitable hardware for opening, closing or securing the window.

Referring to FIG. 2, the glazing fastener system of this invention, generally designated (210), is used for securing a glazing sheet (232) to a frame (222) across the window opening (250) which includes the primary glazing sheet (224), typically constructed of glass. The frame member (220) is mounted along the length of the frame (222) by screws (221) and a double sided adhesive weather strip (230), however, other means of fastening the frame member (220) may be utilized. For ease of installation foamed tape is preferred. The adhesive on the weather strip is used only to temporarily secure the frame member (220) to the frame (222), to enable screws (221) to be secured. The frame member (220) comprises two legs (228 and 252) hingedly joined to each other at substantially right angles. One leg (252) is mounted by the tape (230) and screws (221) to the length of the frame (222). The other leg (228) has mounted thereto a first magnetic element (226).

The magnetic element (226) is preferably a permanent magnet, well known in the art, containing barrium ferrite. The magnetic element (226) is an extruded strip which is mounted to leg (228) by the two retaining lips (262) projecting from leg (228) along the length of the leg between which the magnetic element (226) is retained. The magnetic element (226) has retaining grooves (264) running along the length of magnetic element (226).

The magnetic element (226) may be conveniently formed from any well known, commercially available material. Such materials are relatively flexible and may, for example, be formed by extrusion of a rubber stock containing barrium ferrite. The magnetic force is controlled by the nature of the strip and manner in which it is magnetized, so that it will have sufficient holding power to hold the glazing sheet (232) and glazing retaining member (256) securely but not so great as to make it difficult for the average person to remove the sheet (232) and retaining member (256). The size and weight of the window will, among others, be factors in the selection of an appropriate type of magnet.

Preferably the legs (228 and 252) of the frame member (220) are hingedly joined to each other. This is accomplished for example, by extruding frame member (220) from a dual durometer type material, i.e. legs (228 and 252) are of a less flexible material than the common hinge between them (266).

The hinge connection between the legs of the frame member (220) corrects for irregular angles in the frame (222), allowing for the upstanding leg (228) to change its position sufficiently so that first magnetic element (226) comes in near perfect fit with a contact wall 267 of the second magnetic element (254), attached to the glazing sheet retaining member (256) and provides for easier installation. Preferably the hinge material has a durometer hardness as measured by ASTM-D-2240, of from A-60 to A-72, preferably A60 to A68(shore). The legs have a durometer hardness greater than about D 70, preferably D 75 to D 81 (shore).

It should be noted that any method of mounting magnetic element (226) to frame member (220) may be utilized as long as it is non-adhesively i.e. mechanically, mounted thereto.

A glazing sheet (232) of suitable size is provided to cover the window opening (250) and is preferably translucent. The glazing retaining member (256) extends along and is mounted to the edges of glazing sheet (232). The retaining member (256) has outer and inner legs (234 and 236) connected to each other at one end by a connecting web (268). Preferably, each leg (234, 236) tapers convergingly towards its outer end and the retaining member (256) material is sufficiently resilient that when glazing sheet (232) is inserted into the open end of the legs (234, 236), the legs spread sufficiently to firmly grip the glazing sheet (232). The edges of the glazing sheet (232) are thus retained and mounted between the legs of the retaining member (256).

The second magnetic element (254) is preferably a ferro-type material e.g. iron, steel, etc. which is non-adhesively, i.e. mechanically, mounted to the inner leg (236). Broadly, the inner leg (236) and the second magnetic element (254) are both shaped and mounted to each other to form a rigidized elongated hollow structural member, generally designated (258) therebetween along the length of the glazing sheet (232).

Figure 3:
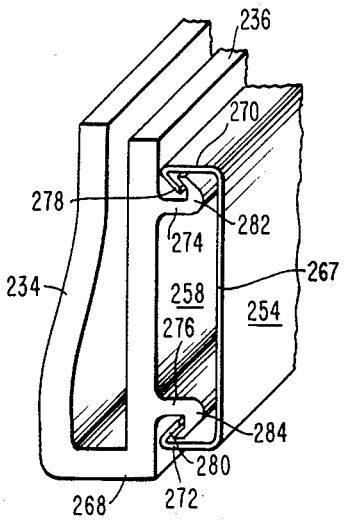
FIGS. 3 through 10 are perspective cross-section views of different embodiments of the glazing retaining member used in the glazing fastener system of this invention.

As depicted in FIG. 2, and more clearly in FIG. 3, the second magnetic element (254) and the inner leg (236) both have projecting retaining lips (270, 272, 274, 276) which rigidly interlock to mount the magnetic element (254) to the inner leg (236). The pair of spaced projecting retaining lips (274, 276) on the inner leg (236) defining a central elongated channel (275) between the retaining lips (274, 276). The retaining lips on the second magnetic element includes a hook-shaped lip (278, 280) which is integral with the magnetic element (254) and runs along its length. This rigidly interlocks with similar retaining hook-shaped lips (282, 284) projecting from and integral with inner leg (236). The hook-shaped lips (282, 284) of the retaining lips (274, 276) diverging from one another thereby defining spaced retaining channels (277, 279 respectively) on the outer sides thereof. The hook-shaped lips (278, 280) of the retaining lips (270, 272) converging toward one another and extending into the retaining channels (277, 279) on the outer sides of the retaining lips (274, 276) of the inner leg (236). The contact wall (267) of the second magnetic element (254) is thereby positioned outwardly beyond the inner leg (236) and the pair of retaining lips (272, 274) thereon.

As depicted in FIGS. 3 through 10 this invention contemplates numerous embodiments for non-adhesively or mechanically mounting the second magnetic element to the inner leg. The embodiment depicted in FIG. 2 and 3 has been described.

Figure 4:
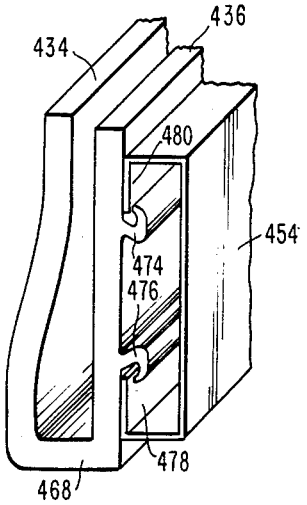

FIG. 4 depicts another means for attaching the magnetic element (454) to the inner leg (436). In this embodiment the retaining lips (474, 476) projecting from the inner leg (436) are hook shaped in a similar manner to that in FIG. 3, however they retain lips (478, 480) against inner leg (436).

Figure 5:
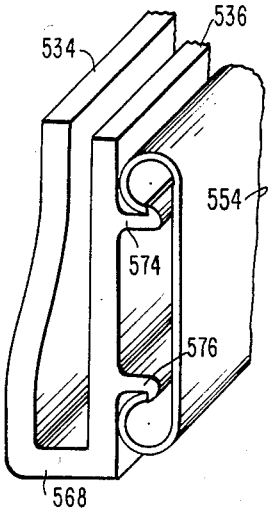

FIG. 5 depicts extended hook-shaped retaining lips (574, 576) projecting from inner leg (536) and retaining lips (570, 572) are circular and retained by lips (574, 576) forcing the other surface of the curve into the inner leg (536).

Figure 6:
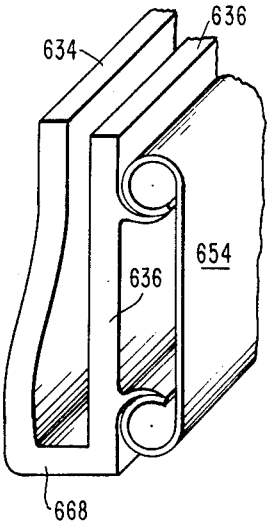
Figure 6A:
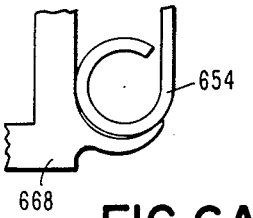

In FIG. 6 the retaining lips (670-676) are mating concentrically curved retaining lips. FIG. 6A shows another embodiment of this type.

Figure 7:
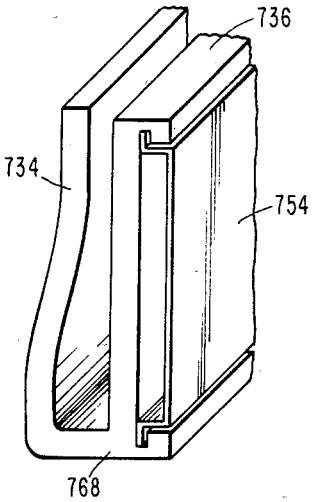

FIG. 7 depicts another type mounting means wherein the retaining lips (774, 776) project from the top and bottom of the inner leg (736) to retainingly grip mating lips (770, 772) from the magnetic element (754).

Figure 8:
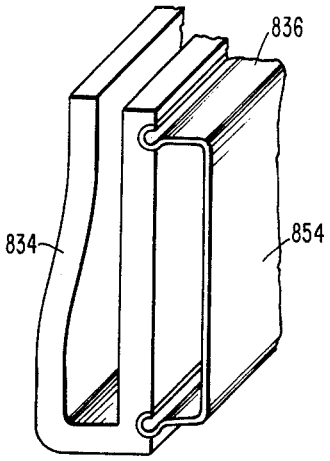

FIG. 8 depicts another type means for attaching the magnetic element (854) to the inner leg (836) wherein the magnetic element (854) has two retaining lips (870, 872) projecting therefrom ending in a longitudinal bead (873) which mates with longitudinal groove (874) in the inner leg (836).

Figure 9:
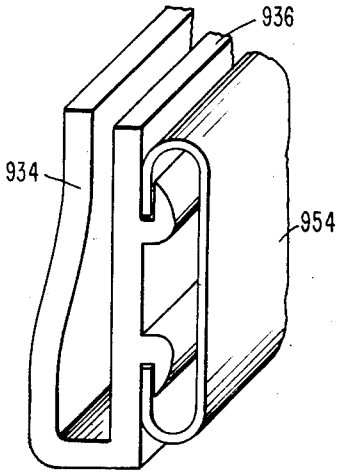
Figure 10:
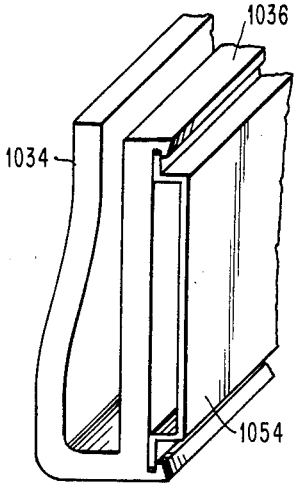

FIGS. 9 and 10 depict other type mounting means for non-adhesively mounting the second magnetic elements (954, 1054) to the inner leg (936, 1036) of the glazing retaining member (956, 1056).

Figure 11:
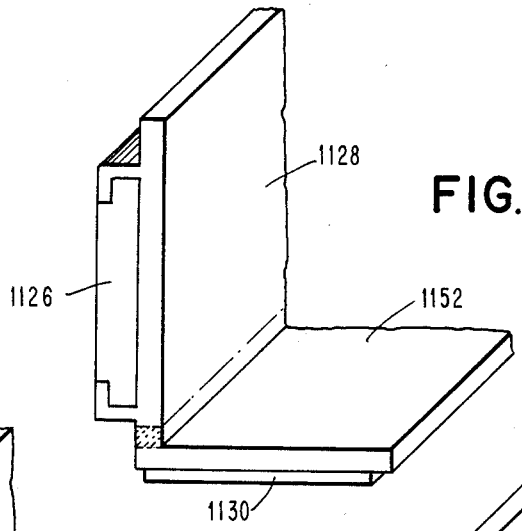
FIGS. 11 through 13 are perspective cross-sectional views of different embodiments of the frame member used in the glazing fastener system of this invention.
Figure 12:
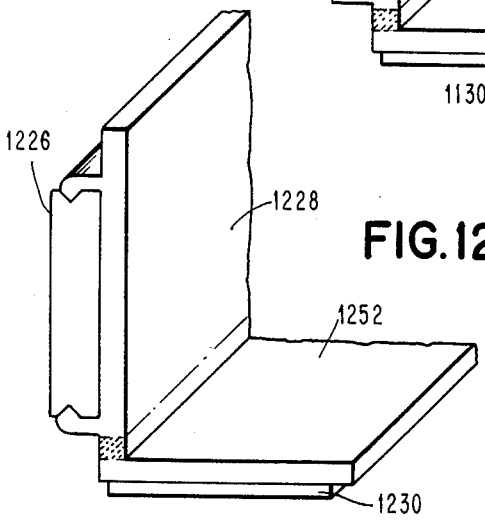
Figure 13:
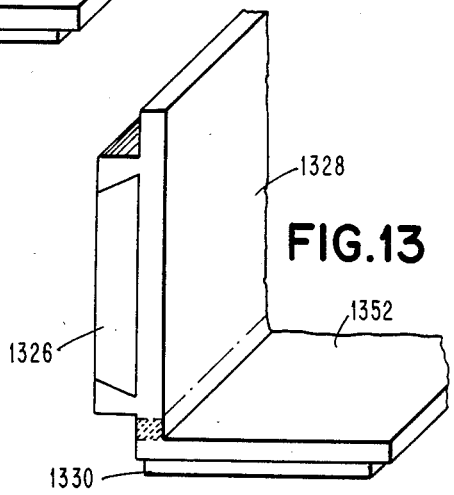

FIGS. 11 through 13 depict different embodiments for mounting the first magnetic element to the upstanding leg of the frame member;

FIG. 11—integral projecting lips (1162) from upstanding leg (1128) maintains the first magnetic element (1126) in attachment to leg (1128) by gripping outer ledge (1164) on magnet (1126);

FIG. 12 is identical to the preferred embodiment depicted in FIG. 2 and was previously described;

FIG. 13 integrally projecting and downwardly tapered lips (1362) from upstanding leg (1328) mate with the upwardly tapered edges of magnet (1326).

Preferably all of the elements, i.e. the frame member, glazing retaining member and first and second magnetic elements are extruded members, which, when assembled to each other slidably mate together.

The frame member and glazing retaining member are preferably extruded sections consisting of a polymeric material, such as polyvinyl chloride (PVC), polypropylene, etc. The frame member likewise could be made of aluminum or other suitable material selected so as to be resistant to deterioration when exposed to weather, attic heat, moisture or other conditions which prevail in connection with the use of this glazing system.

Other modifications or embodiments will suggest themselves to persons skilled in the art, all within the purview, scope and spirit of the disclosure. For example, the placement of the magnetized element and ferromagnetic element can be reversed so that the former is located on the frame member and the latter on the glazing retaining member. Additionally, the frame member may be suitably designed for a frame which is in a vertical position.

The term "translucent" in referring to the glazing panel as used herein is intended to be construed in a general sense as relating to any capability for the conveyance of light through the material, and the term is intended to include mediums ranging from fully transparent or clear materials to substantially light dispersing or reflective materials. The capability of supplementing existing primary panes with tinted or reflective panes is an important option in that panes of this type can be attached in summer months to reduce the entry of sunlight, and hence the creation of solar heat, within an air conditioned space. Alternatively, such panes are often used in winter months to reduce the glare of snow reflection.

In addition, however, it is contemplated that the removable panes may be light-altering in nature to an even greater degree in that such panes may be totally opaque, absorptive or reflective for special purposes such as photographic darkrooms or the like. The panels may also be insulating, e.g. styrofoam, decorative, informative, etc.

Installation of the glazing system of this invention is achieved by non-adhesively attaching the leg of the frame member to the frame for example by screws, inserting the first magnetic element in the retaining lips on the upstanding frame leg, placing the glazing retaining member around the edges of the glazing sheet, mounting the second magnetic element to the inner leg of the glazing retaining member and then matingly attaching the magnetic elements together.

Once the frame member has been mounted to the frame of the window and the glazing retaining member mounted thereto the glazing sheet can be removed by merely pulling the glazing retaining member, by for example, handles mounted thereto to separate the magnetic elements.

While the invention is described in connection with a typical window opening it can be appreciated that the invention is equally applicable to weather resistant doors and windows of various sizes and shapes and to existing panes of various materials including glass, plastics and acrylics.

Various materials such as glass, plastic, nylon or the like may be used for the removable glazing panel depending upon the intended use. Particularly desirable panels have been made from acrylic sheets which are light in weight and flexible enough to allow for ease in removal and application.

From the foregoing it will be evident that we have, in one embodiment, invented a new useful storm window structure held magnetically to the surfaces of window frames, either inside or outside the building, providing a structure which is neat in appearance, having excellent thermal insulation ability, easily applied and removed and capable of being securely mounted to the frame of a window opening without sagging.

Although the present invention has been described with particular reference to specific details of certain embodiments thereof, it is not intended that such details shall be regarded as limitations upon the scope of the invention except insofar as included in the accompanying claims.

What is claimed is:

1. A panel fastener system for securing a panel to a frame across an opening comprising:

a frame member mounted along the length of the frame and having a first magnetic element non-adhesively mounted thereto;

a panel means of suitable size to cover the opening;

a panel retaining member extending along and mounted to the edges of the panel, the retaining member having an outer and an inner leg connected to each other at one end, the edges of the panel being retained and mounted therebetween;

a second magnetic element non-adhesively mounted to the inner leg, the first and second elements being magnetically attachable to each other;

wherein the inner leg and second magnetic element mounted thereto are both shaped and mounted to each other to form a rigidized elongated hollow structural member therebetween along the length of the edges of the panel.

2. The panel fastener system of claim 1, wherein the frame member comprises two legs joined to each other at substantially right angles, one leg of which is mounted to the length of the frame and the other leg having mounted thereto the first magnetic element.

3. The panel fastener system of claim 2, wherein the legs of the frame member are hingedly joined to each other.

4. A panel fastener system for securing a panel to a frame across an opening comprising:

a frame member mounted along the length of the frame and having a first magnetic element non-adhesively mounted thereto;

a panel means of suitable size to cover the opening;

a panel retaining member extending along and mounted to the panel, the retaining member having an outer and an inner leg connected to each other at one end, the edges of the panel being retained and mounted therebetween;

a second magnetic element non-adhesively mounted to the inner leg, the first and second element being magnetically attachable to each other;

wherein the frame member comprises two legs hingedly joined to each other at substantially right angles to each other, one leg of which is mounted to the length of the frame and the other leg having mounted thereto the first magnetic element.

5. The panel fastener system of claim 4, wherein the inner leg and second magnetic element mounted thereto are both shaped and mounted to each other to form a rigidized elongated hollow structural member therebetween along the length of the edges of the panel.

6. The panel fastener system of claim 3 or 5, wherein the panel is a glazing sheet of acrylic.

7. The panel fastener system of claim 3 or 5, wherein the frame and panel retaining member are polyvinyl chloride (PVC) or acrylonitrile-butadiene-styrene (ABS).

8. The panel fastener system of claim 2, 3, 4 or 5, wherein the first magnetic element is mounted to the leg by two retaining lips projecting from the leg along the length of the leg between which the magnetic element is retained.

9. The panel fastener system of claim 1, or 5, wherein the second magnetic element and inner leg each have a pair of projecting retaining lips which rigidly interlock to each other to mount the magnetic element to the inner leg.

10. The panel fastener system of claim 8, wherein the first magnetic element is an elongated extruded member slidably mountable between the retaining lips.

11. The panel fastener system of claim 9, wherein the second magnetic element is an elongated extruded member slidably mountable within the pair of projecting retaining lips of the inner leg.

12. A panel retaining member for mounting to the edges of a panel comprising:

an elongated member having an outer and an inner leg connected to each other at one end, the edges of the panel being retained and mounted therebetween, the inner leg having a pair of spaced projecting retaining lips diverging from one another and defining spaced retaining channels on the outer sides of the retaining lips;

an elongated magnetic element having a U-shaped cross-section and being non-adhesively mounted to the inner leg, the magnetic element having a contact wall and a pair of projecting retaining lips converging toward one another;

wherein the inner leg and magnetic element are interlocked to each other by the pairs of projecting retaining lips thereon to form a rigidized elongated hollow structural member therebetween along the length of the edges of the panel, the retaining lips of the magnetic element extend into the retaining channels on the outer sides of the retaining lips of the inner leg and the contact wall of the magnetic element is thereby positioned outwardly beyond the inner leg and the pair of retaining lips thereon.

13. The panel retaining member of claim 12, wherein the member is polyvinyl chloride (PVC) or acrylonitrile-butadiene-styrene (ABS).

14. The panel retaining member of claim 12, wherein the magnetic element is an elongated extruded member slidably mountable within the pair of projecting retaining lips of the inner leg.

15. A frame member used in combination with a panel retaining member thereby forming a panel fastening system comprising first and second legs, the first leg adapted to be mounted to a framing member, a magnetic element mounted to the second leg by two retaining lips projecting from the second leg along the length thereof between which the magnetic element is retained, and hinge means joining the first and second legs so the legs normally extend at a right angle relative to each other and for permitting the legs to move relative to each other, the hinge means has a durometer hardness of about A-60 to A-72 and the legs have a durometer hardness greater than D-70 (shore).

16. The frame member of claim 15, wherein the frame is polyvinyl chloride (PVC) or acrylonitrile (ABS).

17. The frame member of claim 15, wherein the magnetic element is an elongated extruded member slidably mountable between the retaining lips.

18. The frame member of claim 16, wherein the hinge means has a durometer hardness of about A-60 to A-68 and the legs have a durometer hardness of about D-75 to D-81 (shore).

* * * * *